US007670151B2

(12) United States Patent
Yang

(10) Patent No.: US 7,670,151 B2
(45) Date of Patent: Mar. 2, 2010

(54) METHOD OF PRODUCING A STRADDLE MOUNT CONNECTOR AND THE RESULTING PRODUCT THEREOF

(75) Inventor: Qian-Song Yang, ShenZhen (CN)

(73) Assignee: Hon Hai Precision Ind. Co., Ltd., Taipie Hsien (TW)

( * ) Notice: Subject to any disclaimer, the term of this patent is extended or adjusted under 35 U.S.C. 154(b) by 0 days.

(21) Appl. No.: 12/228,975

(22) Filed: Aug. 18, 2008

(65) Prior Publication Data

US 2009/0047803 A1 Feb. 19, 2009

(30) Foreign Application Priority Data

Aug. 17, 2007 (CN) ..... 2007 2 0042942

(51) Int. Cl.
*H01R 12/00* (2006.01)

(52) U.S. Cl. ..... 439/79; 439/378; 439/475

(58) Field of Classification Search ..... 439/79, 439/378, 475, 569
See application file for complete search history.

(56) References Cited

U.S. PATENT DOCUMENTS

| | | | | |
|---|---|---|---|---|
| 5,277,596 | A | 1/1994 | Dixon | |
| 5,897,386 | A | 4/1999 | Baxter et al. | |
| 6,190,183 | B1 * | 2/2001 | Yang et al. | 439/79 |
| 6,478,603 | B1 * | 11/2002 | Wu | 439/378 |
| 6,997,752 | B2 | 2/2006 | Kato et al. | |
| 7,382,946 | B2 * | 6/2008 | Oggioni et al. | 385/14 |
| 7,389,012 | B2 * | 6/2008 | Oggioni et al. | 385/14 |
| 2003/0096517 | A1 * | 5/2003 | Ho | 439/79 |

* cited by examiner

*Primary Examiner*—Gary F. Paumen
(74) *Attorney, Agent, or Firm*—Wei Te Chung; Andrew C. Cheng; Ming Chieh Chang

(57) ABSTRACT

An electrical connector comprises a dielectric housing and a plurality of conductive contacts retained in the dielectric housing. The dielectric housing comprises a pair of guiding portions and an engaging portion between the guiding portions. The engaging portion comprises an upper engaging plane, and a parallel opposite lower engaging plane. A mounting plane defined between the upper engaging plane and lower engaging plane. The guiding portion defining a lower face aligned with the mounting plane. Each the contact comprises a tail portion extending to the mounting plane.

11 Claims, 6 Drawing Sheets

METHOD OF PRODUCING A STRADDLE MOUNT CONNECTOR AND THE RESULTING PRODUCT THEREOF

BACKGROUND OF THE INVENTION

1. Field of the Invention

The present invention is generally related to the art of the method of aligning a straddle mount type electrical connector to a printed circuit board (PCB), and more particularly to the resulting product thereof.

2. Description of Related Art

Referring to FIG. 6, a section view of a through hole mount type connector mounted on a PCB 7 is shown. The connector comprise a dielectric housing 5, a board lock 6 is secured in the dielectric housing 5, the board lock 6 comprises a retaining portion 63 secured in the dielectric housing 5, and a pair of legs 61 extending down from the retaining portion 63, each leg defining a hook 62 thereon. The PCB 7 comprises a through hole 71 therein. When mounting, the legs 61 is inserted though the though hole 71 with the hooks 62 hold a bottom 72 of the PCB 7, so the dielectric housing 5 of the connector is reliably fixed to the PCB 7.

With the development of a surface mount technology (SMT), it is possible to reduce the mounting stature of the connector for the printed circuit board and to realize a connector for a PCB having a narrow pitch contactor. The SMT is a technique in which, instead of through-hole mounting, lead parts overlap a contact pad (or land) formed on the PCB and are soldered thereto using a soldering device such as a hot-air circulation reflow soldering device. In the straddle mount type connector manufactured by the SMT, the lead parts of the connector are soldered to an edge connector comprised of contact pads. When a board lock is not used, the connector is difficult to be aligned to a PCB.

Hence, an improved electrical connector is required to overcome the disadvantages of the prior art.

SUMMARY OF THE INVENTION

Accordingly, an object of the present invention is to align a straddle mount type electrical connector to a printed circuit board.

In order to achieve the above-mentioned object, prepare a printed circuit board comprising a pair of supporting boards and a predefined breaking slit between each the supporting board with the printed circuit board. Prepare an electrical connector comprises a dielectric housing and a plurality of conductive contacts retained in the dielectric housing. The dielectric housing comprises a pair of guiding portions and an engaging portion between the guiding portions. The engaging portion comprises an upper engaging plane, and a parallel opposite lower engaging plane. A mounting plane defined between the upper engaging plane and lower engaging plane. The guiding portion defining a lower face aligned with the mounting plane. Each the contact comprises a tail portion extending to the mounting plane. When mounting, put the electrical connector on the printed circuit board with the guiding portion stand on the supporting board. After soldering the electrical connector, break off the supporting board along the breaking slit.

Other objects, advantages and novel features of the present invention will become more apparent from the following detailed description of the present embodiment when taken in conjunction with the accompanying drawings.

DETAILED DESCRIPTION OF THE INVENTION

Figure 1:
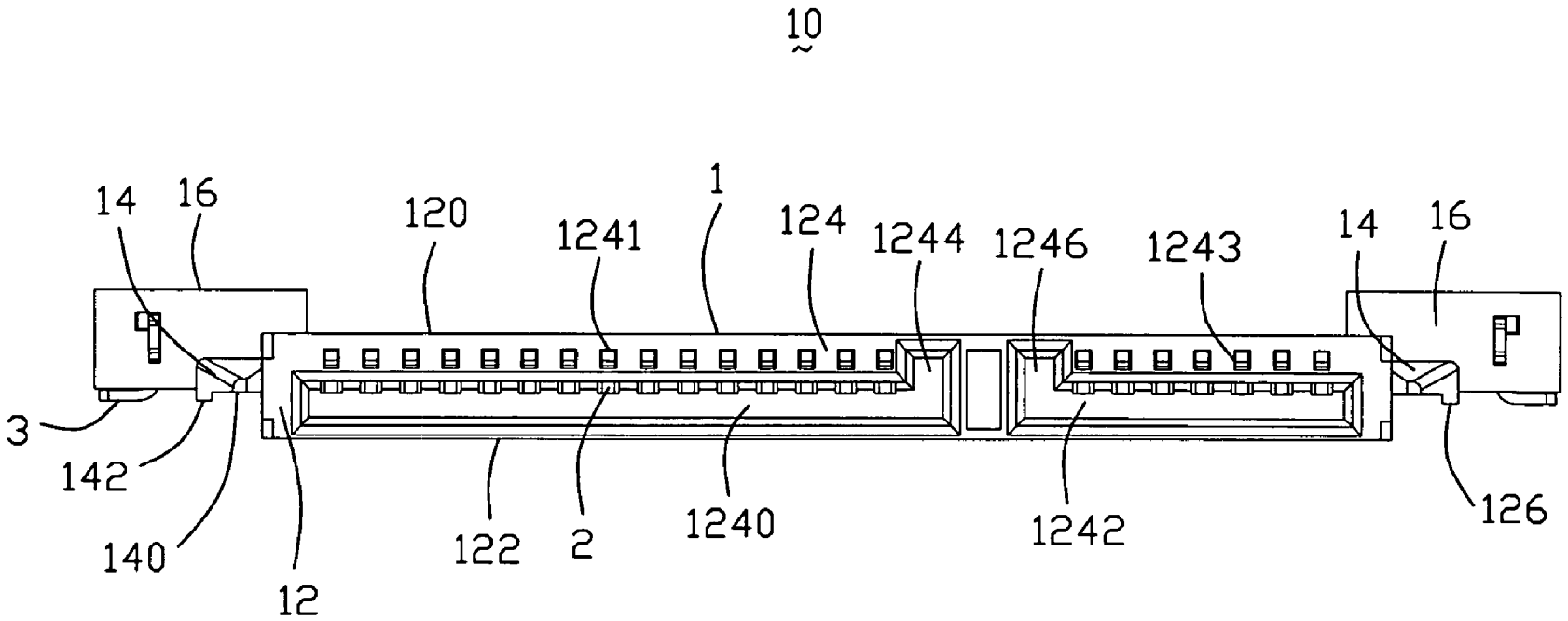
FIG. 1 is a front view of an electrical connector of a preferred embodiment of the present invention.
Figure 2:
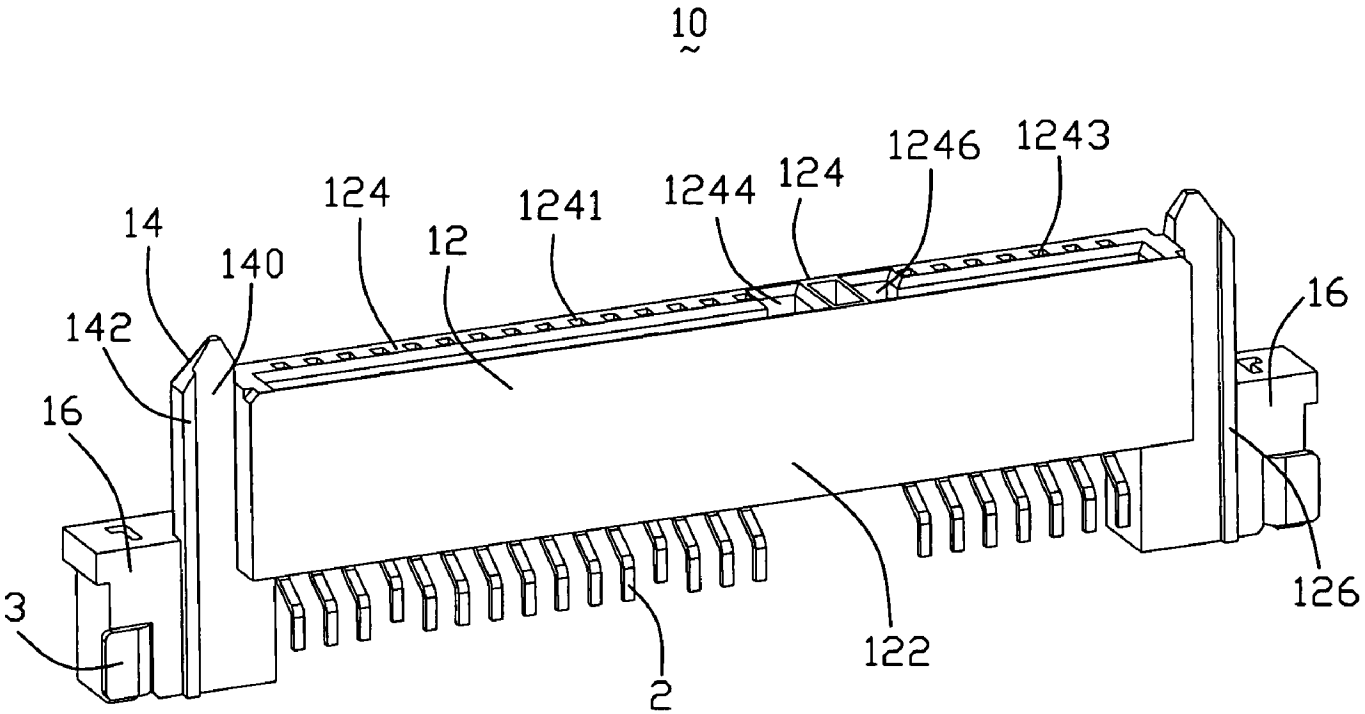
FIG. 2 is an perspective view of the electrical connector as shown in FIG. 1, a lower portion is shown.
Figure 3:
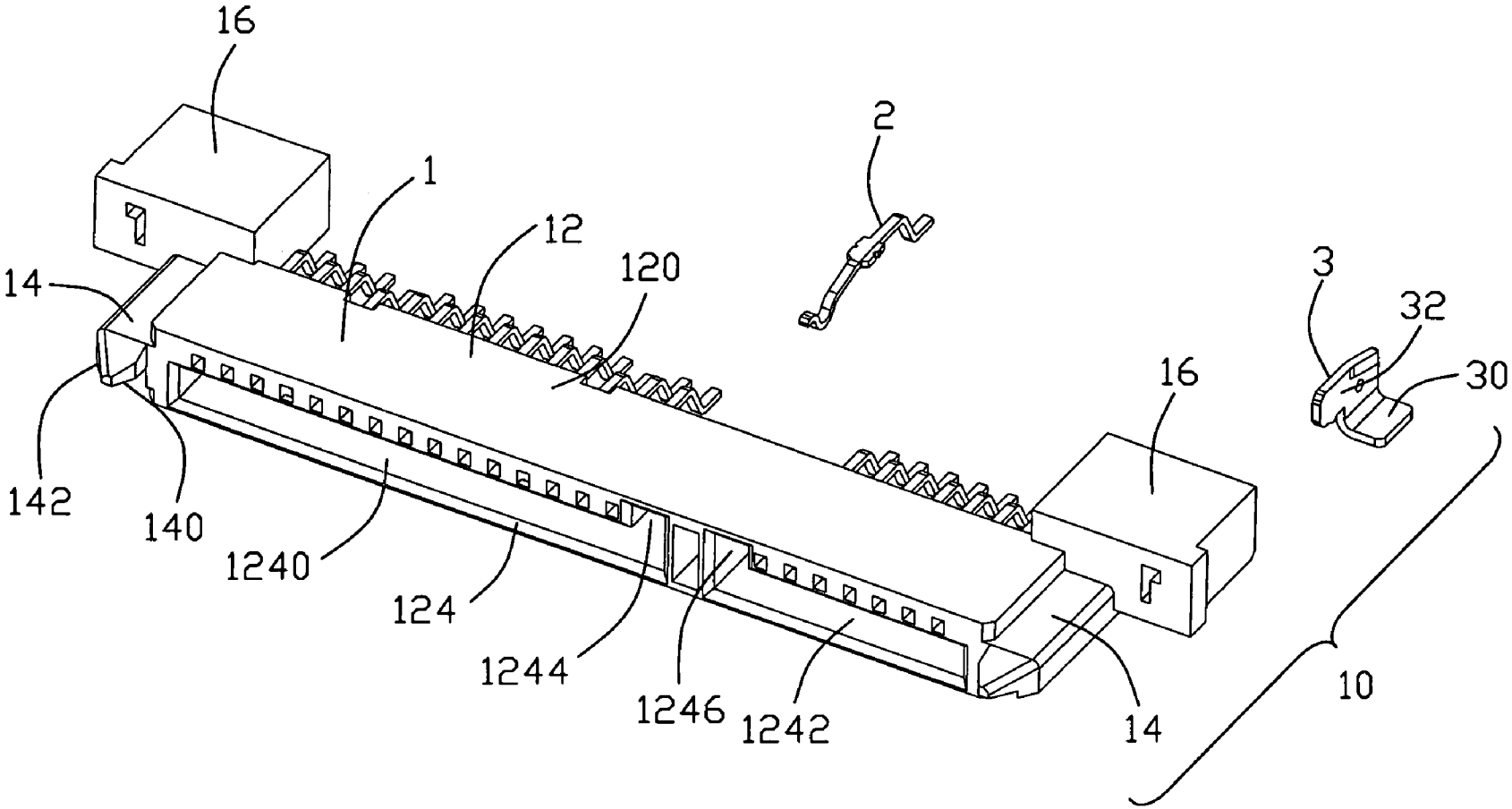
FIG. 3 is a perspective view of the electrical connector as shown in FIG. 1, a conductive contact and a board lock are disassembled.

Reference will now be made in detail to the preferred embodiment of the present invention.

Referring to FIGS. 1-5, an electrical connector 10 used to mount on a printed circuit board 4 and to mate with a complementary connector (not shown), comprises a dielectric housing 1, a plurality of conductive contacts 2 and a pair of board locks 3 respectively secured in the dielectric housing 1.

The dielectric housing 1 comprises a pair of guiding portions 14, an engaging portion 12 between the guiding portions 14 and a pair of blocks 16 at the rear area adjacent to the pair of guiding portions 14. The engaging portion 12 comprises an upper engaging plane 120, an opposite lower engaging plane 122 parallel to the upper engaging plane 120, a front engaging surface 124 adjacent to the upper and lower engaging planes 120, 122, and two slots 1240, 1242 extending backwardly from the front engaging surface 124 in a place between the upper and lower engaging planes 120, 122. The two slots 1240, 1242 can engage two tongue boards of the complementary connector (not shown). Each slot 1240, 1242 defines a plurality of passages 1241, 1243 in a lateral wall, and a foolproof recess 1244, 1246 in the lateral wall (not labeled) at the end near the other slot 1240, 1242 for engaging a key on the tongue board of the complementary connector (not shown), so wrong direction mating with the complementary connector (not shown) will be prevented.

A mounting plane 126 is defined between the upper engaging plane 120 and lower engaging plane 122, so the electrical connector 10 can be straddle mounted on a printed circuit board 4. For the electrical connector 10 is partial above the printed circuit board 4, a low profile will be seen when mounted.

The guiding portion 14 extends forward and beyond the front engaging surface 124, can engage the complementary connector (not shown) first when mating, so it is easy to complete mating process of the complementary connector under the guide. The guiding portion 14 defines a lower face (not labeled) defining a rib 142 extending forward and a recess 140 extending forward, the rib 142 aligned with the mounting plane 126, the recess 140 stand off the mounting plane 126 and in a place between the rib 142 and the engaging portion 12. This structure is helpful for improving the engaging precision between the electrical connector 10 and the printed circuit board 4.

Each block 16 defines a lower face (not labeled) facing the mounting plane 126. Each board lock 3 comprises a retaining section 32 secured in the block 16 and a mounting section 30 exposed on the lower face (not labeled) of the block for soldering on the printed circuit board 4. The blocks can support the electrical connector 10 and the board locks 3 can strengthen the retention between the electrical connector 10 and the printed circuit board 4.

Each the conductive contact 2 comprises a section (not labeled) projecting out from passages 1241, 1243 and exposed in the slot 1240, 1242 for touching a complementary contact on the tongue board of the complementary connector (not shown), so electrical connection between the electrical connector 10 and the complementary connector (not shown) can be established. Each the contact further comprises a tail portion extending to the mounting plane for soldering on the printed circuit board. The tail portions of the plurality of conductive contacts are extending between the pair of blocks, so the tail portions are protected by the dielectric housing and are not easy to be hurt.

Figure 4:
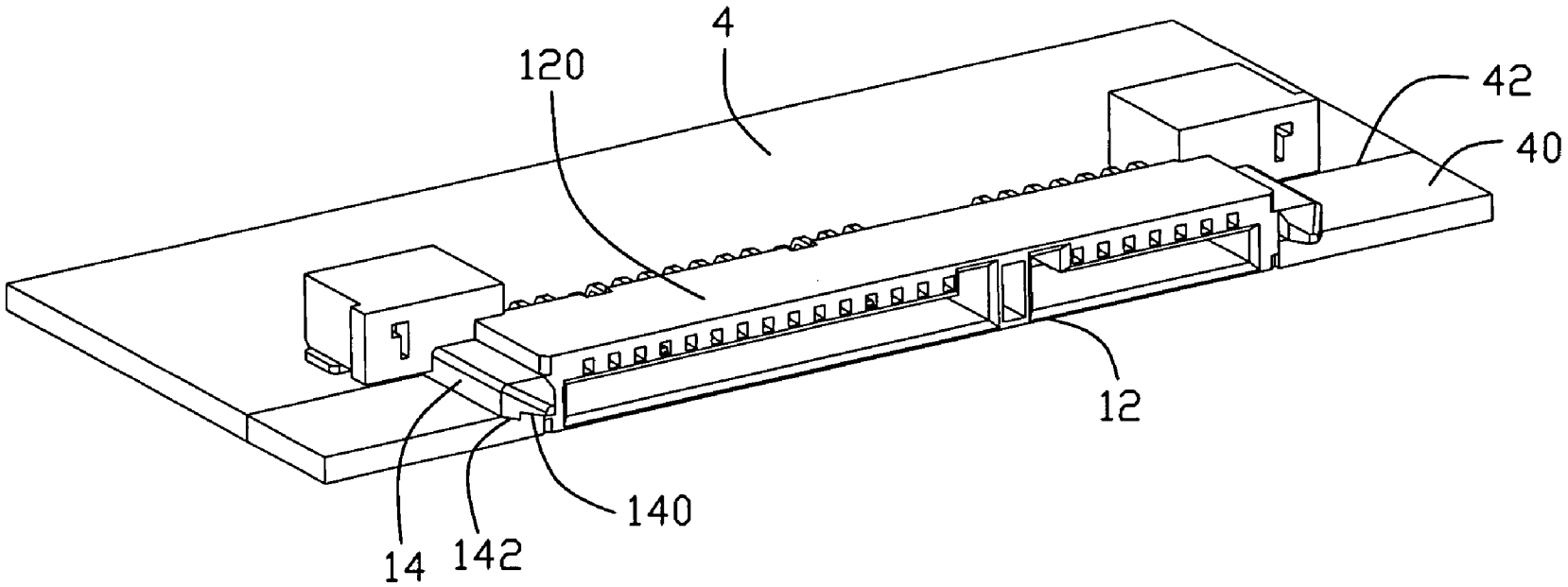
FIG. 4 is a perspective view of the electrical connector as shown in FIG. 1 mounted on a circuit board.
Figure 5:
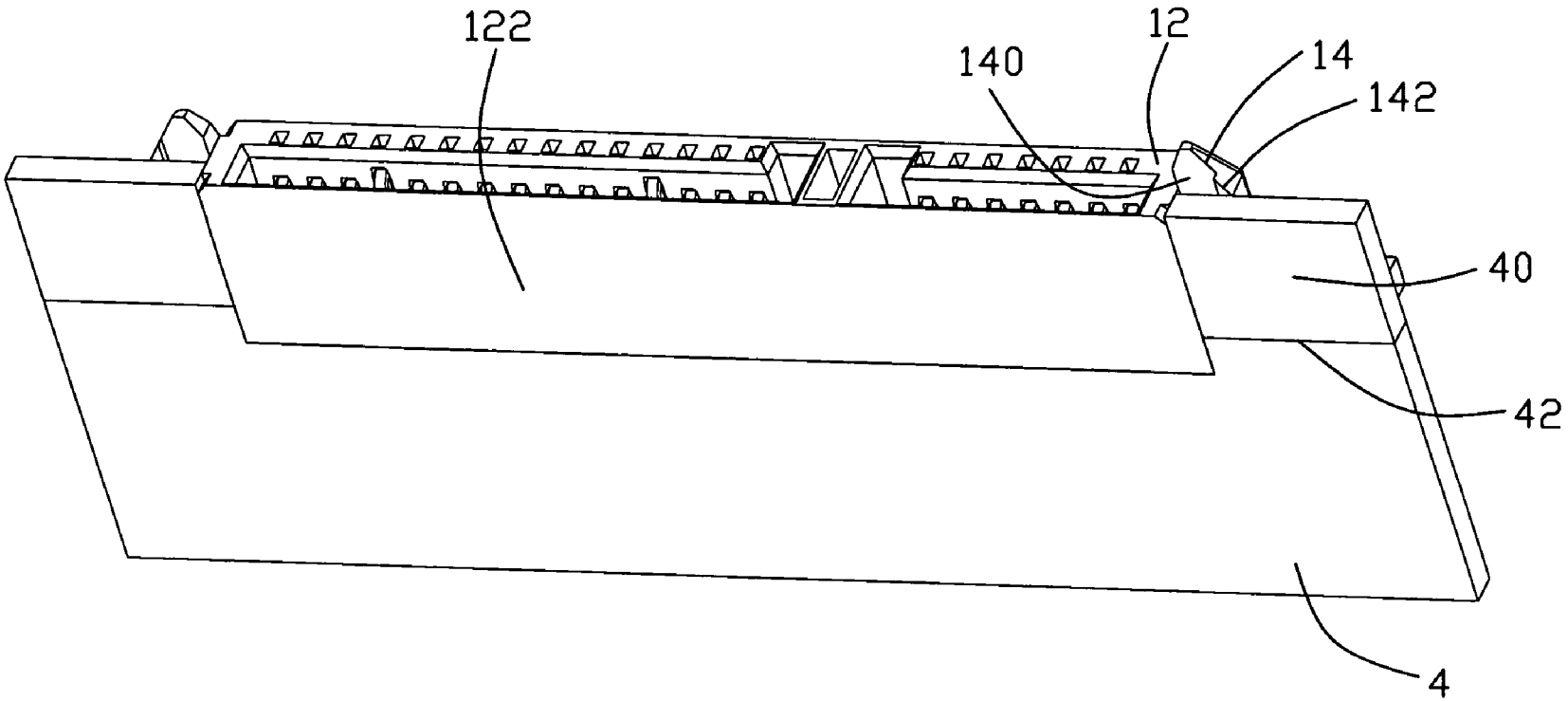
FIG. 5 is a perspective view of the electrical connector mounted on a circuit board as shown in FIG. 4, viewed from another direction.
Figure 6:
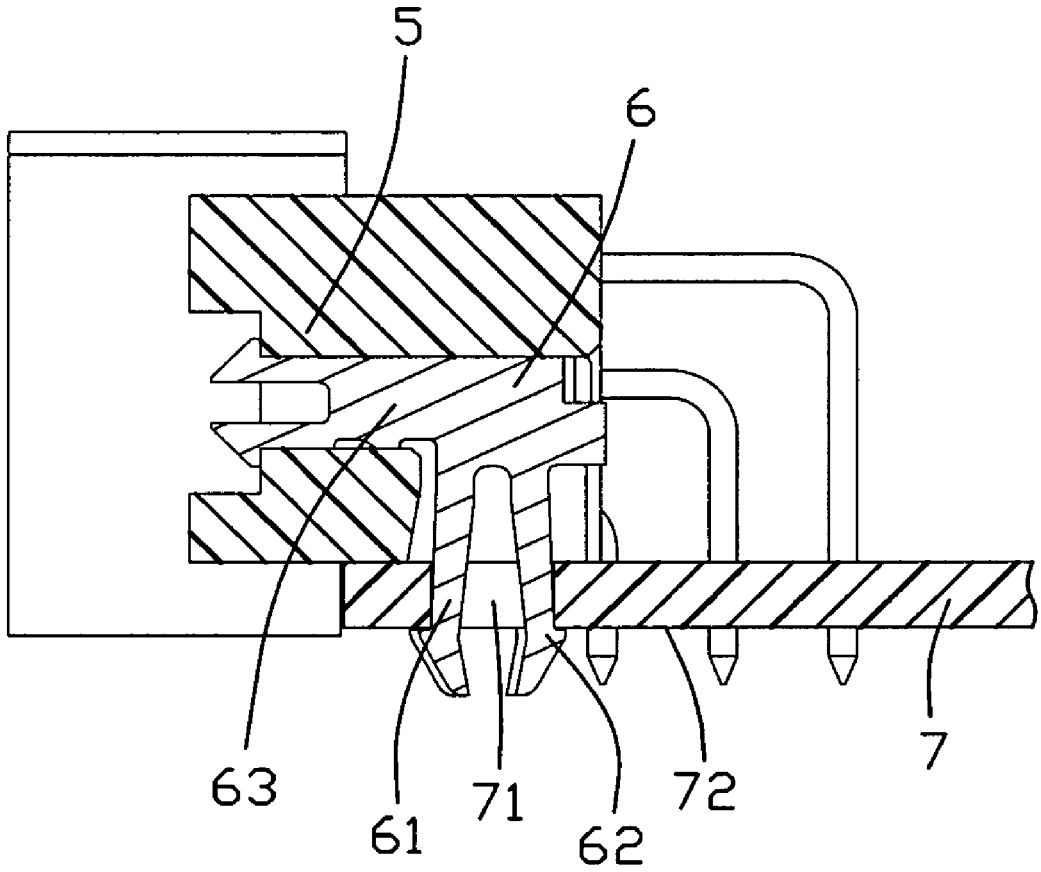
FIG. 6 (PRIOR ART)
FIG. 6 is a section view of an electrical connector in the related art mounted on a circuit board.

Specially referring to FIGS. 4-5, the printed circuit board 4 comprises a supporting board 40 and a predefined breaking slit 42 combine the supporting board 40 with the printed circuit board 4. When mounting, the electrical connector 10 can stably stand on the printed circuit board 4 with the guiding portion 14 stand on the supporting board 40. After soldering the electrical connector 10, the supporting board 40 can be break off along the breaking slit 42.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising:

a dielectric housing, comprising a pair of guiding portions and an engaging portion between said guiding portions; said engaging portion comprising an upper engaging plane, and an opposite lower engaging plane parallel to the upper engaging plane;

the housing further defining a mounting plane between said upper engaging plane and lower engaging plane for mounting to a printed circuit board, said guiding portion defining a lower face being coplanar with said mounting plane; and a plurality of conductive contacts retained in said dielectric housing, each said contact comprising a tail portion extending to said mounting plane.

2. The electrical connector as described in claim 1, wherein said engaging portion comprises a front engaging surface adjacent to said upper and lower engaging planes, said guiding portions extending forward and beyond said front engaging surface.

3. The electrical connector as described in claim 2, wherein said lower face of each said guiding portion defines a rib extending forward and a recess extending forward, said rib being coplanar with said mounting plane, said recess standing off said mounting plane and in a place between said rib and said engaging portion.

4. The electrical connector as described in claim 3, wherein said engaging portion comprises a slot extending backwardly from said front engaging surface in a place between said upper and rower engaging planes, each of said conductive contacts comprising a section exposed in said slot projecting from a lateral wall of said slot.

5. The electrical connector as described in claim 3, wherein said engaging portion comprises two slots extending backwardly from said front engaging surface in a place between said upper and lower engaging planes, each of said conductive contacts comprising a section exposed in said slot projecting from a lateral wall of said slot, each slot defining a foolproof recess in said lateral wall at the end near the other slot.

6. The electrical connector as described in claim 3, wherein said dielectric housing further comprises a pair of blocks at the rear area adjacent to said pair of guiding portions, each of said blocks defining a lower face with thereon a corresponding board lock being coplanar with said mounting plane for mounting to the printed circuit board, said tail portions of said plurality of conductive contacts are extending between said pair of blocks.

7. An electrical connector assembly comprising:

a printed circuit board defining a front edge and a front edge region right behind the front edge;

an electrical connector defining a pair of mounting towers at two opposite ends and mounted upon the front edge region, and an engaging portion between said pair of mounting towers and extending forwardly beyond the front edge, and a pair of guiding portions located at two ends of the engaging portion and extending forwardly beyond the front edge; and a supporting board initially linked to a front edge of the printed circuit board while successively breakable therefrom so as to have the guiding portions supported upon the supporting board during mounting the connector to the printed circuit board while allowing the guiding portions to be fully exposed to an exterior for guidance during use after removal of the supporting board from the printed circuit board.

8. The electrical connector assembly as claimed in claim 7, wherein the printed circuit board defines a cutout to allow a lower portion of the engaging portion to be received therein.

9. The electrical connector assembly as claimed in claim 7, wherein the supporting board is coplanar with the printed circuit board on both surfaces thereof.

10. The electrical connector assembly as claimed in claim 7, wherein a bottom face of the engaging portion is located below an upper surface of the printed circuit board.

11. The electrical connector assembly as claimed in claim 7, wherein said supporting board defines a cutout to receive the engaging portion therein.

* * * * *